US010839998B2

(12) United States Patent
Wikus et al.

(10) Patent No.: US 10,839,998 B2
(45) Date of Patent: Nov. 17, 2020

(54) MAGNET ASSEMBLY WITH CRYOSTAT AND MAGNET COIL SYSTEM, WITH COLD RESERVOIRS ON THE CURRENT LEADS

(71) Applicant: Bruker BioSpin AG, Faellanden (CH)

(72) Inventors: Patrick Wikus, Nuerensdorf (CH); Joerg Hinderer, Waldshut-Tiengen (DE); Marco Strobel, Karlsruhe (DE)

(73) Assignee: BRUKER SWITZERLAND AG, Faellanden (CH)

( * ) Notice: Subject to any disclaimer, the term of this patent is extended or adjusted under 35 U.S.C. 154(b) by 118 days.

(21) Appl. No.: 16/155,262

(22) Filed: Oct. 9, 2018

(65) Prior Publication Data

US 2019/0108932 A1 Apr. 11, 2019

(30) Foreign Application Priority Data

Oct. 9, 2017 (DE) ..... 10 2017 217 930

(51) Int. Cl.
*H01F 1/00* (2006.01)
*H01F 6/06* (2006.01)
*H01F 6/04* (2006.01)

(52) U.S. Cl.
CPC ..... *H01F 6/06* (2013.01); *H01F 6/04* (2013.01); *H01F 6/065* (2013.01)

(58) Field of Classification Search
CPC ..... H01F 6/04; H01F 6/06; H01F 1/00
(Continued)

(56) References Cited

U.S. PATENT DOCUMENTS 3,588,312 A * 6/1971 Buraler ..... F17C 3/085 174/15.4
4,535,595 A * 8/1985 Keller ..... G01R 33/3815 505/892

(Continued)

FOREIGN PATENT DOCUMENTS

CN 101796597 A 8/2010
CN 102360694 A 2/2012

(Continued)

OTHER PUBLICATIONS

Rizzo, Enrico: "Simulations for the optimization of High Temperature Superconductor current leads for nuclear fusion applications", 2013.

*Primary Examiner* — Shawki S Ismail
*Assistant Examiner* — Lisa N Homza
(74) *Attorney, Agent, or Firm* — Edell, Shapiro & Finnan, LLC

(57) ABSTRACT

A magnet assembly (1) with a cryostat (2) has a superconducting magnet coil system (3), an active cooling device (4) for the coil system, and current leads (5*a*, 5*b*) for charging the coil system. The current leads have at least one normal-conducting region (15*a*, 15*b*), wherein multiple cold reservoirs (20) are thermally coupled to the current leads along the normal-conducting region thereof, in order to absorb heat the normal-conducting region during charging of the magnet coil system. The current leads have a variable cross-sectional area B in the normal-conducting region along the extension direction thereof, wherein at least over a predominant fraction of their overall length in the normal-conducting region, the cross-sectional area B decreases from a cold end (18*a*, 18*b*) toward a warm end (19*a*, 19*b*). This provides a magnet assembly requiring reduced cooling
(Continued)

power during charging, with less heat introduced into the magnet coil system in normal operation.

22 Claims, 5 Drawing Sheets

(58) Field of Classification Search
USPC ..... 335/216
See application file for complete search history.

(56) References Cited

U.S. PATENT DOCUMENTS 4,895,831 A 1/1990 Laskaris
4,943,781 A * 7/1990 Wilson ..... H05H 13/00 313/62
4,959,964 A * 10/1990 Saho ..... F17C 3/085 250/352
4,986,078 A * 1/1991 Laskaris ..... F17C 3/085 335/216
5,220,800 A * 6/1993 Muller ..... G01R 33/3815 335/216
5,302,928 A 4/1994 Laskaris et al.
5,317,296 A 5/1994 Vermilyea et al.
5,586,437 A 12/1996 Blecher et al.
5,623,240 A * 4/1997 Sakuraba ..... H01F 6/065 174/15.4
5,686,876 A * 11/1997 Yamamoto ..... H01F 6/065 174/15.4
5,744,959 A * 4/1998 Jeker ..... G01R 33/3815 324/319
6,107,905 A * 8/2000 Itoh ..... F17C 3/085 335/216
6,998,947 B2 * 2/2006 Penn ..... F17C 3/085 324/318
7,812,319 B2 * 10/2010 Diehl ..... G21K 1/093 250/396 ML
8,896,312 B2 * 11/2014 Stauffenegger .... G01R 33/3403 324/321
9,014,769 B2 * 4/2015 Harrison ..... H01F 6/04 505/162
2003/0122643 A1 * 7/2003 Wakuda ..... G01R 33/421 335/299
2005/0110491 A1 * 5/2005 Havens ..... G01R 33/3875 324/318
2006/0021355 A1 * 2/2006 Boesel ..... F25D 19/00 62/51.1
2006/0022779 A1 * 2/2006 Jiang ..... G01R 33/3815 335/216
2006/0066429 A1 * 3/2006 Kasten ..... G01R 33/3815 335/296
2006/0097146 A1 * 5/2006 Strobel ..... F25B 9/02 250/286
2006/0130493 A1 * 6/2006 Strobel ..... F25D 19/006 62/51.1
2008/0227647 A1 * 9/2008 Beneduce ..... H01F 6/065 505/163
2009/0038318 A1 * 2/2009 Begg ..... H01F 6/04 62/47.1
2009/0210199 A1 * 8/2009 Tsuda ..... G01R 33/3804 702/188
2011/0080239 A1 * 4/2011 Westphal ..... G01R 33/3815 335/216
2014/0094371 A1 * 4/2014 Zwart ..... H01F 6/06 505/180
2015/0369888 A1 * 12/2015 Calvert ..... G01R 33/3854 324/307
2017/0025850 A1 1/2017 Rey et al.
2017/0038123 A1 * 2/2017 Strickland ..... F25D 29/001
2017/0363697 A1 * 12/2017 Jonas ..... G01R 33/3815
2019/0024950 A1 * 1/2019 Ebara ..... H01F 6/06
2020/0041176 A1 * 2/2020 Wikus ..... F25B 19/005

FOREIGN PATENT DOCUMENTS

CN 102592773 A 7/2012
CN 105097179 A 11/2015
CN 106461287 A 2/2017
CN 107134767 A 9/2017
DE 69324436 T2 8/1999
DE 102007013350 A1 9/2008
EP 0350268 A2 1/1990
EP 2624262 A2 8/2013
GB 2476716 A 7/2011
GB 2506009 A 3/2014
JP H0423305 A 1/1992
JP H06231950 A 8/1994
JP 2016178112 A 10/2016

* cited by examiner

MAGNET ASSEMBLY WITH CRYOSTAT AND MAGNET COIL SYSTEM, WITH COLD RESERVOIRS ON THE CURRENT LEADS

CROSS REFERENCE TO RELATED APPLICATIONS

This application claims foreign priority under 35 U.S.C. § 119(a)-(d) to German Application No. 10 2017 217 930.9 filed on Oct. 9, 2017, the entire contents of which are hereby incorporated into the present application by reference.

FIELD OF THE INVENTION

The invention relates to a magnet assembly, comprising a cryostat, a superconducting magnet coil system, an active cooling device for the magnet coil system, and current leads for charging the magnet coil system in the cryostat, wherein the current leads comprise at least one normal-conducting region, in particular wherein the current leads also comprise an HTS region, wherein multiple cold reservoirs are thermally coupled to the current leads along the normal-conducting region of the current leads, in order to absorb heat arising in the normal-conducting region during the charging of the magnet coil system.

Such a magnet assembly is known from JP H04 23305 A.

BACKGROUND

Strong magnetic fields, which can be generated with superconducting magnet coil systems, are required for nuclear magnetic resonance (NMR) measurements. The superconducting magnet coil systems can carry large electric currents without loss, using which the strong magnetic fields are generated. However, cooling to cryogenic temperatures below the transition temperature of the superconducting material in the magnet coil system is necessary for the superconducting state. The superconducting magnet coil systems are therefore arranged in a cryostat. To minimize the helium consumption of the cryostat, active cooling devices are sometimes used, for example pulse tube coolers, using which a cryogenic temperature can be maintained continuously and cost-effectively.

To charge a superconducting magnet coil system within a cryostat with electric current, current leads extend in the cryostat from the room-temperature outer wall of the cryostat to the magnet coil system. At least one section of these current leads is normal-conducting in this case ("normal-conducting region"); a lower section (closer to the magnet coil system) of the current leads is often also made of a high-temperature superconductor (HTS) material. During the charging, electric current flows through the current leads, which generates ohmic heat in the normal-conducting region. During normal operation (also called "steady-state" operation), no electric current typically flows through the current leads ("persistent mode"), but the current leads represent thermal bridges, which introduce heat into the magnet coil system.

The thermal load is typically significantly higher during charging than in normal operation due to multiple effects (for example, operation of the "persistent mode switches" or ohmic dissipation in the current leads). To prevent an excessively high temperature, which results in a quench (loss of superconductivity), from arising on the magnet coil system or also in the HTS region of the current leads during the charging, the active cooling device can be dimensioned sufficiently large that the cooling device can also compensate for the thermal load of the charging. However, this results in high production costs and high maintenance costs, a large structural size, and requirements for cooling and power supply which have to be oriented to the peak load required during charging. Since the charging typically only lasts a few hours, but normal operation usually lasts many weeks or months, the active cooling device is not utilized to capacity most of the time.

In the case of a cryogenic container of the cryostat filled with a liquid cryogen (such as liquid helium), a higher coolant consumption can simply be accepted during charging, but this causes high costs.

Coupling a current lead to the upper cooling stage of a two-stage cooler, and furthermore coupling on a thermal inertia member in the region of this upper cooling stage in the case of a cryogen-free cryogenic cooler system is known from EP 2 624 262 A2. The thermal inertia member can reduce a temperature increase during the charging or discharging of a cooled superconducting coil.

Current leads for a superconducting magnet system, on which heat storage material is arranged, are known from JP H04 23305 A. In one embodiment, the current leads are tubular and the heat storage material is arranged in the tube, wherein the heat storage material is divided in the interior of the tube by layers of a thermally insulating material. The current leads are cooled with a helium gas flow.

Disconnectable current leads for a superconducting magnet are known from GB 2 506 009 A, U.S. Pat. No. 5,317,296, CN 102 360 694 A, and CN 102 592 773 A. By disconnecting the current leads after the charging, an introduction of heat can be prevented in normal operation. However, this approach is technically difficult and is linked to high production costs.

A current lead for a superconducting magnet is known from U.S. Pat. No. 5,302,928, which is divided between the interface at room temperature and the magnet coil, and is coupled to a heat sink at the point of the division. The lead extension, which is introduced into the current path and results in elevated ohmic resistance due to additional contact resistances, is disadvantageous.

Current leads, which are cooled using liquid cryogens, are known from JP H06 231950, GB 2 476 716 A, and DE 10 2007 013 350 A1.

A superconducting magnet system is known from DE 69 324 436 T2, the current leads of which consist of high-temperature superconductor material at the end close to the coil, and the warm end of which is not mechanically fastened.

An MRI cryostat with an inner heat shield and an outer heat shield is described in U.S. Pat. No. 5,586,437, wherein a separate cooling device is provided for cooling the outer heat shield.

SUMMARY

One object of the invention is providing a magnet assembly, in which a reduced cooling power is required during the charging of the superconducting magnet coil system, and an introduction of heat into the superconducting magnet coil system is reduced in normal operation.

This object is achieved in a surprisingly simple and effective manner by a magnet assembly of the type mentioned at the outset, which is characterized in that the current leads have a variable cross-sectional area B in the normal-conducting region along the extension direction thereof, wherein the cross-sectional area B decreases from a cold end towards a warm end at least over a predominant fraction of the overall length of the current leads in the normal-conducting region.

It is proposed in the scope of the present invention that the current leads be provided with a special geometry in the normal-conducting region thereof, in order to optimize the current leads for the requirements during charging, on the one hand, and in normal operation, on the other hand, wherein multiple cold reservoirs are thermally coupled to the current leads along the normal-conducting region of the current leads.

During the charging of the superconducting magnet coil, it is important to reduce the ohmic heat development above all at the cold end of the current leads. The invention therefore provides enlarging the cross-sectional area (perpendicular to the longitudinal extension and/or current flow direction) toward the cold end, such that the ohmic resistance is reduced toward the cold end, insofar as it is related to the cross-sectional area. The heat development close to the cold end is thus also reduced.

In normal operation, but also during charging, it is important to reduce the introduction of heat into the superconducting magnet coil system via the current leads as a thermal bridge to the room-temperature outer wall of the cryostat. The introduction of heat takes place above all from the warm-temperature outer wall of the cryostat. According to the invention, the cross-sectional area of the current leads is therefore reduced in size toward the room-temperature end, which enhances the heat conduction resistance, insofar as it is related to the cross-sectional area.

It is ensured by the simultaneous distribution of multiple cold reservoirs along the current leads in the normal-conducting region that the local delimitations in the heat development and the heat introduction, which are achieved by the geometry of the current leads, can be used over a longer time, and in particular cannot be rapidly balanced out by heat conduction along the current leads. The cold reservoirs slow the balancing process; the duration of a complete charging procedure can readily be buffered by suitable dimensioning of the cold reservoirs (and suitable geometry of the current leads).

It is thus possible to manage the charging with a comparatively low cooling power during the duration of the charging procedure, without the magnet coil system or possibly a superconducting section of the current leads becoming excessively warm and quenching. A cost-effective active cooling device having comparatively lower cooling power can accordingly be used, which requires little structural space. In the case of a cryogen-containing cryostat, the cryogen consumption (coolant consumption) during charging can be minimized. At the same time, however, the heat introduction via the current leads can also be kept low in normal operation, and therefore only a low cooling power is required for this purpose and only low operating costs arise in normal operation.

The current leads in the normal-conducting region typically extend from a connection at room temperature (warm end) up to the magnet coil system or up to an HTS region (or HTS section) of the current leads (cold end); the current lead in the HTS region leads further to the magnet coil system.

The magnet coil system typically has a superconducting short-circuit switch for configuring a persistent mode operation. The short-circuit switch can preferably be operated with a low heating current or a low heating power, for example, with 50 mW or less. The magnet coil system is preferably formed with low temperature superconductor (LTS) materials (in particular NbTi or preferably $Nb_3Sn$ for higher operating temperatures). The operating current of the magnet coil system is advantageously low in normal operation, for example, 100 A or less, preferably 70 A or less. The magnet coil system can preferably be charged with high charging voltages, for example, with 5 V or more.

The active cooling device can be in particular a pulse tube cooler or a Gifford-McMahon cooler. A preferred power consumption of the active cooling device is 2 kW or less, in particular 1.5 kW or less. The active cooling device is preferably operated without coolant water and/or in an air-cooled manner.

The cross-sectional area B of the current leads in the normal-conducting region typically decreases over the entire length of the normal-conducting region from the cold end toward the warm end, but at least over a predominant fraction of the overall length of the current leads in the normal-conducting region. The cross-sectional reduction can take place continuously or in steps or in a mixed form. Sometimes, exceptions are necessary and/or desired in the cross-sectional area profile, in particular at connecting points of current lead parts. Such connecting points usually have a smaller cross-sectional area B ("solder spot"), more rarely a larger cross-sectional area ("solder bead") than the surrounding current lead parts. These exceptions typically make up less than 5%, usually less than 2%, of the overall length of the current leads in the normal-conducting region, and accordingly only have minor influence on the overall heat development in the current lines during the charging of the magnet coil system or on the overall heat introduction from the warm end of the current leads. The cross-sectional area B preferably decreases from the cold end toward the warm end over a fraction of at least 95%, preferably at least 98%, of the overall length of the current leads in the normal-conducting region inside the cryostat.

The active cooling device is preferably arranged inside a tube, which is filled with gas in operation (in particular during charging and in normal operation); an upgrade or replacement of the active cooling device is then possible without breaking the insulation vacuum of the cryostat. This tube can form one of the current leads, for example, as it is provided in any case and thus does not further elevate the thermal load in normal operation. This tube can also be the neck tube of the cryostat, in particular wherein one of the current leads also extends in the neck tube. Any possible excess cooling power which is available at a regenerator of the active cooling device can be used by way of a thermal contact via the gas in the tube for the cooling of the current lead.

PREFERRED EMBODIMENTS

One preferred embodiment of the magnet assembly according to the invention provides, that the current leads each have N successive subsections in the normal-conducting region, with $N \geq 2$, in particular $3 \leq N \leq 7$, wherein the subsections each have a constant cross-sectional area Bi within one subsection, and the cross-sectional areas Bi decrease from the cold end toward the warm end. This embodiment is structurally simple to implement; moreover, the thermal behavior during a charging procedure can be simulated relatively simply and optimized well in accordance with the geometry of the current leads. Heat flow and heat development and/or the temperature distribution in the current lead lines can be set more accurately by a large number of subsections. It is to be noted that this setting can also be optimized further via the ratios Bi/Hi, with Hi: length of the subsection i (along the longitudinal direction/current flow direction). Usually, N≥3 or N≥4 also applies. At least one coupled-on cold reservoir is typically provided per subsection. Alternatively, it is also possible to change the cross-sectional area of a current lead continuously along the extension direction.

In one preferred refinement of this embodiment, different subsections are thermally coupled to different cold reservoirs. In this structural form, the cold reservoirs each only have a (direct) coupling to one of the subsections; a connection to other subsections only takes place indirectly via the first subsection. The formation of a strong temperature gradient in the current lead lines is thus facilitated. The cold reservoirs can each contact the subsection, for example, approximately in the middle (with respect to the extension direction).

In another refinement, at least one cold reservoir is thermally coupled on at each transition of two subsections, in particular wherein at least one cold reservoir is also thermally coupled on the cold end of the current lead in the normal-conducting region. This is usually particularly structurally simple. One or more cold reservoirs at the cold end ensure particularly good protection of the superconducting magnet coil system (or an HTS region of the current lead lines).

An embodiment is also preferred in which K stages of the thermal coupling are configured along each of the current leads in the normal-conducting region, wherein at least one cold reservoir is thermally coupled to the current leads at each stage, with K≥2, in particular 3≤K≤7. K≥3 or K≥4 is also advantageous. The heat flow and/or the temperature distribution in the current leads can be set more accurately by a larger number of stages of the thermal coupling. Moreover, the cold reservoirs are used in a more thermodynamically efficient manner. Furthermore, in the case of N subsections, each of constant cross section Bi, K=N or K=N+1 is preferable. A stage of the thermal coupling corresponds to a contact of a current lead by one or more cold reservoirs at a specific longitudinal position along the current lead; different stages of the thermal coupling thus contact a current lead in the normal-conducting region at different longitudinal positions.

A refinement of this embodiment is advantageous in which a heavy mass Mi of cold-storing material in the at least one cold reservoir of a respective stage of the thermal coupling decreases over the stages from the cold end toward the warm end. The specific heat capacity of most cold-storing materials (such as metals) increases strongly with higher temperature (in the cryogenic range), and therefore such large (absolute) heavy masses are not required toward the warm end. The concept of the "heavy" mass (i.e., generating weight force) of a cold reservoir is used here to avoid confusion with the "thermal mass" (i.e., the absolute heat capacity).

An embodiment is preferred in which the cryostat is designed as a cryogen-free cryostat. In this case, an elevated thermal load during the charging cannot be balanced out by accepting an elevated cryogen consumption during the charging. In this case, the invention enables the use of an active cooling device having low cooling power, which is cost-effective and compact. A cryostat is understood as cryogen-free here if cryogens cannot escape from the system in any operating state to be expected (i.e., not even during charging or in the event of a quench). The magnet coil system is typically arranged directly in the vacuum of the vacuum container in this case (and in particular not in a cryogen tank with liquid cryogen, in which the magnet coil system is immersed).

An embodiment is also preferred in which at least some of the cold reservoirs are formed as gas-tight containers, wherein a part of the volumes of the gas-tight containers are filled with an evaporable substance. In this structural form, heat energy can be bound by evaporating the evaporable substance (which is evaporable at the temperatures prevailing in operation). The evaporable substance can be, for example, nitrogen, krypton, or argon, and can also be neon or helium in a colder range. It is to be noted that in this structural form, the evaporable (usually liquid) substance substantially provides the "heavy mass" of the respective cold reservoir. Moreover, it is to be noted that the container typically consists of material having poor thermal conductivity, for example, of stainless steel or the titanium alloy 15-3-3-3. Multiple containers are typically connected in series along the current leads.

One advantageous refinement of this embodiment provides that the current leads extend at least partially inside the containers in the normal-conducting region. A particularly good heat flow can thus take place. Baffles and radiation shields can be arranged in the containers, in order to minimize the heat flow between the warm and cold ends of the containers due to convection and/or thermal radiation.

Furthermore, an embodiment is preferred in which at least a part of the container is thermally coupled at a lower end via a heat conduction element to a heat sink of the active cooling device, and the boiling point of the substance contained in the container is greater than the temperature of the heat sink. Heat can be withdrawn slowly from the container (after charging) via the heat conduction element, in order to recondense the evaporated substance, typically slowly over multiple hours or also multiple days. In particular, two containers can be used in series, which are coupled to two different cooling stages of the active cooling device (for example, a pulse tube cooler).

An embodiment is also preferred in which at least a part of the cold reservoirs are formed as metallic bodies. This structural form is particularly simple and robust. A good thermal contact between the (metallic) current leads in the normal-conducting region and the metallic bodies is easy to configure directly.

An embodiment is advantageous in this case in which multiple cold reservoirs formed as metallic bodies are arranged spaced apart from one another in a vacuum region of the cryostat. This avoids thermal short-circuits of the cold reservoirs in a simple manner, in particular between cold reservoirs of various stages of the thermal coupling.

An embodiment is particularly preferred in which furthermore an active auxiliary cooling device is provided, which is thermally coupled to a part (piece) of the current leads in the normal-conducting region, in particular wherein a lowest working temperature $AT_{hilf}$ of the auxiliary cooling device is higher than a lowest working temperature $AT_{mss}$ of the active cooling device for the magnet coil system. Additional thermal energy can be withdrawn from the current leads with the auxiliary cooling device, in particular during charging; the active cooling device (which is to cool the magnet coil system above all) can thus be relieved. The auxiliary cooling device typically has an $AT_{hilf}$ in a range from −70° C. to −30° C., usually from −60° C. to −50° C., which is relatively simple to achieve (in particular with lower power consumption), in contrast, $AT_{mss}$ is usually at 4 K to 10 K (−269° C. to −263° C.). An auxiliary cooling device and/or a corresponding cooling coil (associated heat exchanger) is typically arranged in the vacuum container (in vacuum).

One refinement of this embodiment provides that the auxiliary cooling device is furthermore thermally coupled to a radiation shield of the cryostat and/or a vacuum container of the cryostat and/or a temperature control device for a sample to be studied. The active cooling device is thus additionally relieved, in particular in normal operation. If the auxiliary cooling device is used to cool the vacuum container of the cryostat down below the ambient temperature, it is advantageous to thermally insulate the vacuum container. Plastics material foams, for example, are particularly suitable for this purpose. Condensed water, for example, can thus be prevented from forming.

Moreover, an embodiment is preferred in which the cross-sectional area B changes by at least a factor of 3 from the cold end toward the warm end. A very significant relief of the active cooling device with respect to the thermal load during charging can already be achieved by a factor of 3 or more (in relation to the predominant fraction of the current leads in the normal-conducting region).

A use of a magnet assembly according to the invention also falls in the scope of the present invention, wherein the magnet coil system is charged via the current leads and a charging current is selected and the variable cross-sectional area B and/or the cold reservoirs are configured such that for a thermal load $WL_{load}$, which acts maximally on a coldest stage of the current leads in the normal-conducting region during the charging, and for a thermal load $WL_{es}$ on this coldest stage in an equilibrium state with charged magnet coil system, the following applies:

$$WL_{load} \leq 5 * WL_{es}, \text{ in particular } WL_{load} \leq 2 * WL_{es}.$$

The coldest stage (or stage of the thermal coupling) corresponds to the region of the current lead on which the cold reservoir closest to the cold end (or set of cold reservoirs at identical longitudinal positions on the current leads) is thermally coupled. The specified ratios can be achieved well in the scope of the invention and enable the use of active cooling devices (cryogenic coolers) with low cooling power, which is cost-effective, enables a compact construction of the magnet assembly, and contributes to making the integration of the system into a customer laboratory as simple as possible.

Further advantages of the invention result from the description and the drawings. The above-mentioned features and the features indicated hereafter can also be used according to the invention individually or in multiples in any desired combinations. The embodiments which are shown and described are not to be understood as an exhaustive list, but rather have exemplary character for the description of the invention.

BRIEF DESCRIPTION OF THE DRAWINGS

The invention is illustrated in the drawing and will be explained in greater detail on the basis of exemplary embodiments. In the figures.

DETAILED DESCRIPTION

Figure 1:
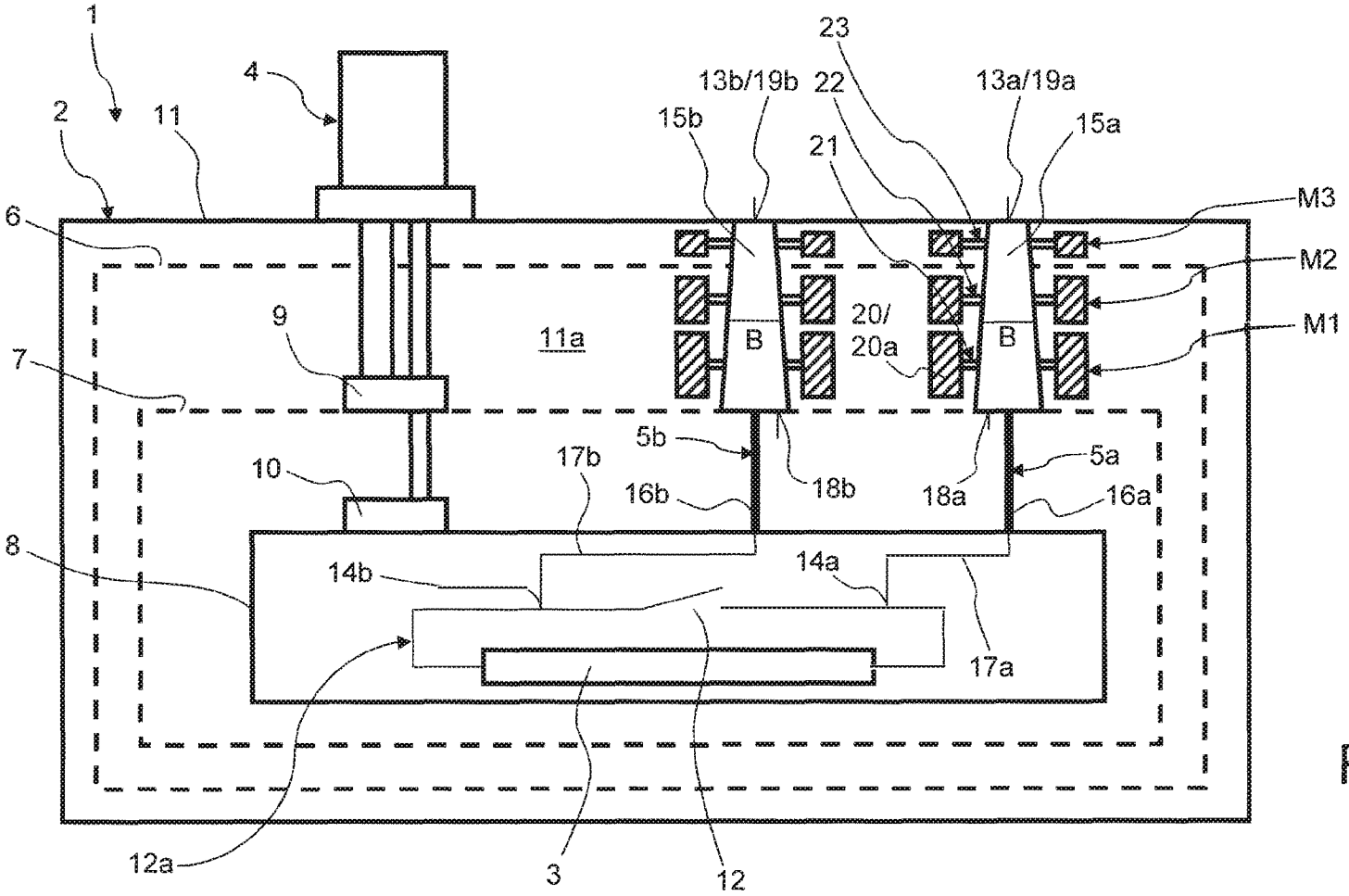
FIG. 1 shows a schematic illustration of a first embodiment of a magnet assembly according to the invention, with metallic bodies as cold reservoirs.

FIG. 1 schematically shows a first embodiment of a magnet assembly 1 according to the invention. It comprises a cryostat 2, a magnet coil system 3, an active cooling device 4, and two current leads 5*a*, 5*b* here for charging the magnet coil system 3.

The cryostat 3 is formed here with a vacuum container 11, an outer radiation shield 6, a middle radiation shield 7, and an inner radiation shield 8. The vacuum container 11, which simultaneously forms the outer wall of the cryostat 2, is at room temperature (approximately 20° C.). The outer radiation shield 6 is at approximately 213 K (approximately −60° C.). The middle radiation shield 7 couples to an upper cooling stage 9 of the active cooling device 4 at approximately 50 K, and the inner radiation shield 8 couples to a lower cooling stage 10 of the active cooling device at approximately 3.5 K; the latter also represents the lowest working temperature $AT_{mss}$ of the active cooling device 4.

The magnet coil system 3, which can be short-circuited to superconduct via a switch 12 of a charging and short-circuit electric circuit 12*a*, is arranged in the interior of the inner radiation shield 8 in vacuum. The magnetic field generated by the magnet coil system 3 can be used, for example, for an NMR measurement in normal operation. The inner radiation shield 8 can also be formed gas-tight, and therefore to improve the thermal conductivity, for example, gaseous helium can be provided and/or contained, which does not have to be filled in the scope of operation (including charging and normal operation) and also cannot escape ("cryogen-free cryostat").

Alternatively to the cryogen-free cryostat, the cryostat 2 can also be designed as a cryogen-containing cryostat (not shown in greater detail in FIG. 1). In this case, a cryogenic container is provided instead of the inner radiation shield 8, which typically contains liquid cryogen (such as helium), in which the magnet coil system 3 is entirely or partially immersed. The cryogen in the cryogenic container can be refilled as needed in operation in the case of cryogen-containing cryostats, possibly even during charging.

The current leads 5*a*, 5*b* lead from connections 13*a*, 13*b* on the vacuum container 11 through the cryostat 3 up to connections 14*a*, 14*b* on the charging and short-circuit electric circuit 12*a*. The current leads 5*a*, 5*b* each comprise for this purpose, in the embodiment shown, a normal-conducting region 15*a*, 15*b* (between vacuum container 11 and middle radiation shield 7), an HTS region 16*a*, 16*b* (between middle radiation shield 7 and inner radiation shield 8), and an LTS region (inside the inner radiation shield 8).

The current leads 5*a*, 5*b* in the normal-conducting region 15*a*, 15*b* each have a cross-sectional area B which continuously decreases from the cold end 18*a*, 18*b* (close to the magnet coil system) to the warm end 19*a*, 19*b* (close to the room temperature connection), recognizable from a diameter decreasing in size upward; the cross-sectional area B is shown by way of example here approximately in the middle (along the longitudinal direction) of the current leads 5*a*, 5*b* in the normal-conducting region 15*a*, 15*b*. The cross-sectional area B decreases in the exemplary embodiment shown by a factor of approximately 3 (it can be seen that the square of the diameter is incorporated into the cross-sectional area B, wherein the diameter ratio of cold to warm is approximately 1.75 here). The cross-sectional reduction is configured here over the entire (vertical) length of the current leads 5*a*, 5*b* in the normal-conducting region 15*a*, 15*b*.

Along the current leads 5*a*, 5*b* in the normal-conducting region 15*a*, 15*b*, cold reservoirs 20 are coupled thereon. The cold reservoirs 20 are formed here as metallic masses 20*a*. In the example shown, three stages 21, 22, 23 of the thermal coupling are configured in each case, wherein two cold reservoirs 20 (left and right) are coupled on at the same longitudinal position (the longitudinal direction extends vertically in FIG. 1) at each of the stages 21, 22, 23. The cold reservoirs 20 of the coldest stage 21 in total have a heavy mass M1 which is greater than the total heavy mass M2 of the cold reservoirs 20 of the middle stage 22, and the total heavy mass M2 of the cold reservoirs 20 of the middle stage 22 is in turn greater than the total heavy mass M3 of the cold reservoirs 20 of the warmest stage 23. The cold reservoirs 20 of the different stages 21-23, and also within the stages 21-23 here, are arranged spaced apart from one another in the vacuum region 11*a* of the vacuum container 11, to avoid a thermal short-circuit.

At the lower, cold end 18*a*, 18*b*, the current leads 5*a*, 5*b* are coupled to the middle radiation shield 7, and therefore a certain cooling power of the upper cold stage 9 of the active cooling device 4 can be used. Moreover, the outer radiation shield 6 also contacts the current leads 5*a*, 5*b* in the normal-conducting region 15*a*, 15*b* here, between the stages 22 and 23 here; alternatively, a non-coupling feedthrough can also be provided on the outer radiation shield 6.

During the charging (or discharging) of the magnet coil system 3 via the current lead lines 5*a*, 5*b*, heat arises in the current leads 5*a*, 5*b* in the normal-conducting region 15*a*, 15*b*, which the cold reservoirs 20 at least partially compensate for by heating the metallic masses 20*a*, whereby a heat introduction into the HTS region 16*a*, 16*b* of the current lines 5*a*, 5*b* or even into the magnet coil system 3 is reduced. The geometry of the current leads 5*a*, 5*b* expanding toward the cold end 18*a*, 18*b* in the normal-conducting region 15*a*, 15*b* reduces the ohmic heat development close to the cold end 18*a*, 18*b*, in this case and reduces a heat introduction from the room-temperature warm end 19*a*, 19*b*. The thermal load (heat flow "downward") in the region of the lowermost stage 21 during the charging $WL_{load}$ can be limited in this case in comparison to the thermal load in the equilibrium state in normal operation $WL_{es}$, and therefore $WL_{load} \leq 2*WL_{es}$. The remaining thermal load $WL_{load}$ can be compensated for by the active cooling device 4, and therefore the superconducting magnet coil system 3 and also the HTS region 16*a*, 16*b* of the current leads 5*a*, 5*b* do not heat up impermissibly (above the respective transition temperature).

Figure 2:
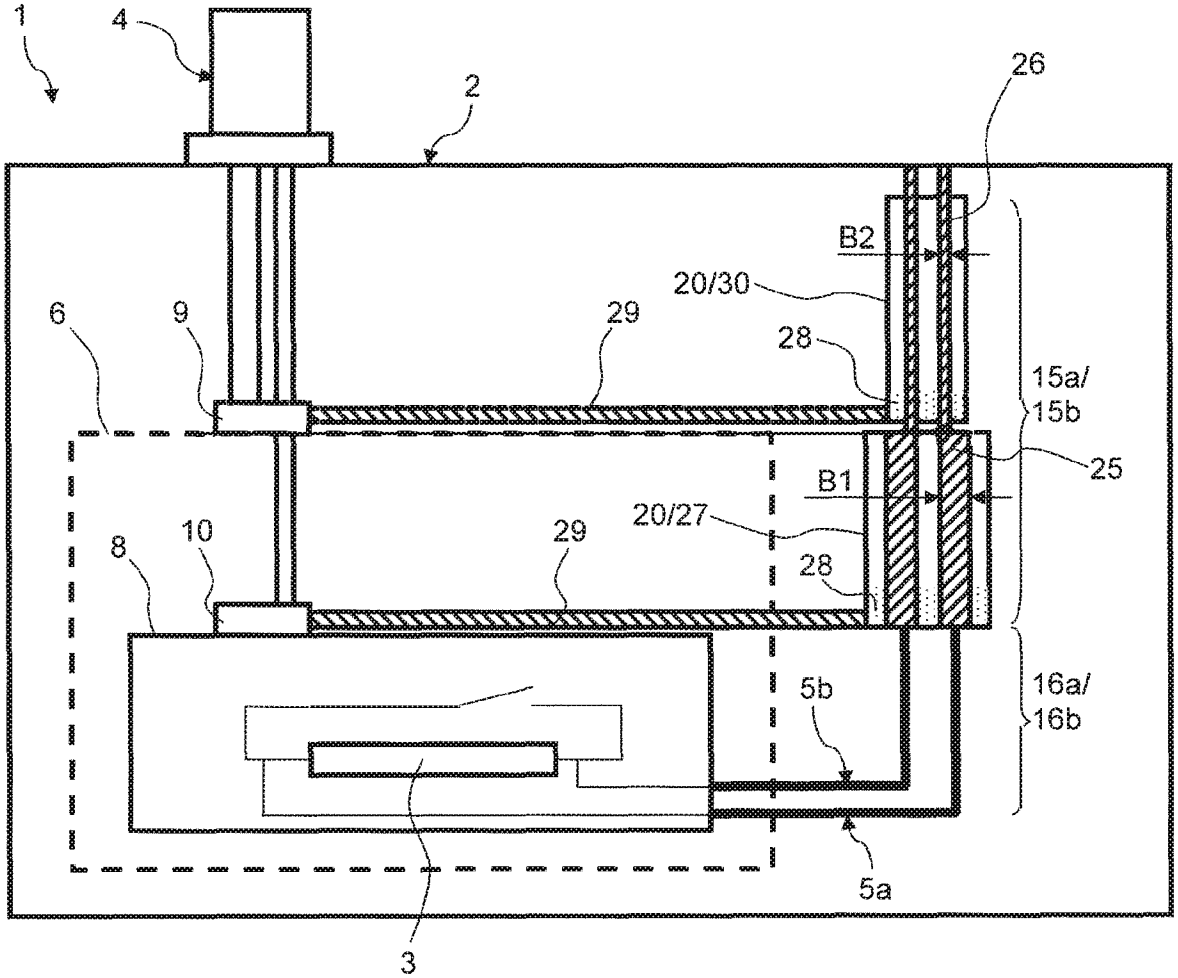
FIG. 2 shows a schematic illustration of a second embodiment of a magnet assembly according to the invention, with containers filled with evaporable substance as cold reservoirs.

FIG. 2 shows a second embodiment of a magnet assembly 1 according to the invention, which substantially corresponds to the structural form of FIG. 1; only the essential differences will be explained hereafter.

The cryostat 2 only has an outer radiation shield 6, which is coupled on the upper cooling stage 9 of the active cooling device 4, and also an inner radiation shield 8, which is coupled on the lower cooling stage 10, but not a middle radiation shield.

The current leads 5*a*, 5*b* in the normal-conducting region 15*a*, 15*b* each extend here with two cylindrical subsections 25, 26, wherein the colder subsection 25 has a significantly larger cross-sectional area Bi in comparison to the cross-sectional area $B_2$ of the warmer subsection 26.

The lower subsection 25 substantially extends in a cold reservoir 20, which is formed with a gas-tight container 27 and an evaporable substance 28 contained therein. The evaporable substance 28 is provided in liquid form; some evaporable substance 28 is already evaporated in the container 27. The lower end of the container 27 is coupled via a heat conduction element 29 to the lower cooling stage 10 of the active cooling device 4.

The upper subsection 26 extends substantially in a cold reservoir 20, which is formed with a gas-tight container 30 and an evaporable substance 28 contained therein. The lower end of the container 30 is coupled via a heat conduction element 29 to the upper cooling stage 9 of the active cooling device 4.

The lower container 27 is significantly larger than the upper container 30, and the lower container 27 contains significantly more evaporable substance 28 (with respect to the heavy mass) than the upper container 30.

During the charging (or discharging) of the magnet coil system 3 via the current lead lines 5*a*, 5*b*, heat arises in the containers 27, 30, which is at least partially compensated for by evaporating the evaporable substance 28 (which elevates the gas pressure in the containers 27, 30), whereby a heat introduction into the HTS region 16*a*, 16*b* of the current leads 5*a*, 5*b* or even into the magnet coil system 3 in the inner radiation shield 8 is reduced. In normal operation, stored heat energy can be gradually dissipated again via the heat conduction elements 29 to the cooling stages 9, 10, which act as heat sinks, and therefore the evaporated substance can recondense again. It is to be ensured in the design of the containers 27, 30 that the evaporation and re-condensing are isochoric processes, since no substance can escape from the containers 27, 30 in operation. The change of the latent heat in the event of rising pressure and rising temperature in the respective container 27, 30 has to be taken into consideration accordingly.

Figure 3:
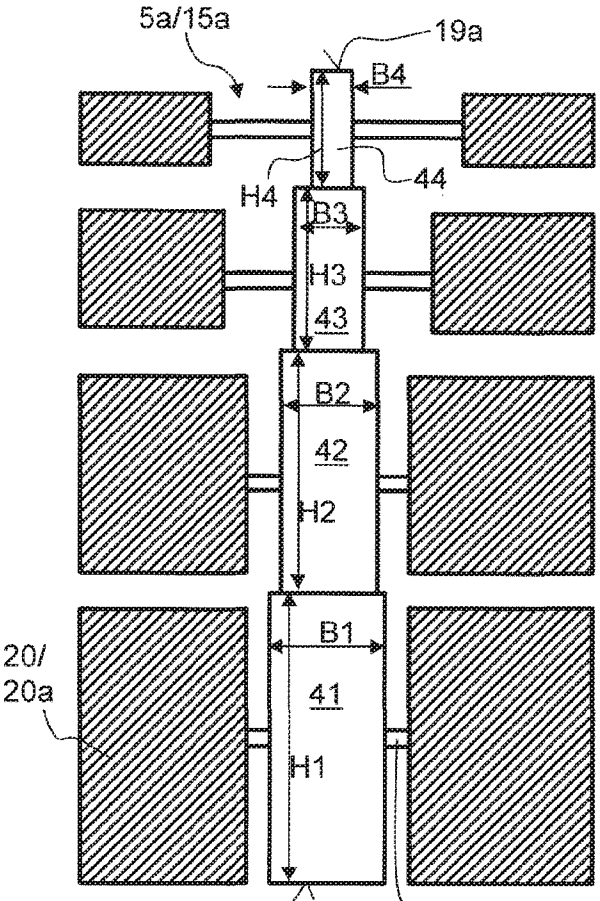
FIG. 3 shows a schematic illustration of a current lead in the normal-conducting region for the invention, with subsections of constant cross-sectional area, with cold reservoirs contacting in the middle.

FIG. 3 shows a current lead 5*a* in the normal-conducting region 15*a* for the invention. It comprises N=4 successive subsections 41, 42, 43, 44 here, wherein each subsection 41-44 has a separate, uniform cross-sectional area B1-B4. The cross-sectional areas B1-B4 decrease from the cold end 18*a* toward the warm end 19*a*.

The different subsections 41-44 are coupled to different cold reservoirs 20, in the form of metallic bodies 20*a* here. The respective two coupled cold reservoirs 20 of a subsection 41-44 each contact their subsection 41-44 here approximately in the middle in relation to the vertical longitudinal extension of the current lead 5*a* via a short bridge element 45. The number K of the stages of thermal coupling, each formed here by the contacting of two cold reservoirs 20 at a common longitudinal position, is also 4 here, and therefore K=N=4 here. The total heavy masses Mi of the cold reservoirs 20 of the four stages of the thermal coupling decrease from the cold end 18*a* toward the warm end 19*a*.

It is to be noted that to set a certain heat flow or temperature profile, the ratio Bi/Hi in the various subsections 41-44 can also be varied, with Hi: length of the subsection i, with i=1 to 4 for the subsections 41-44. The ratio Bi/Hi typically decreases from the cold end 18*a* toward the warm end 19*a*.

Figure 4:
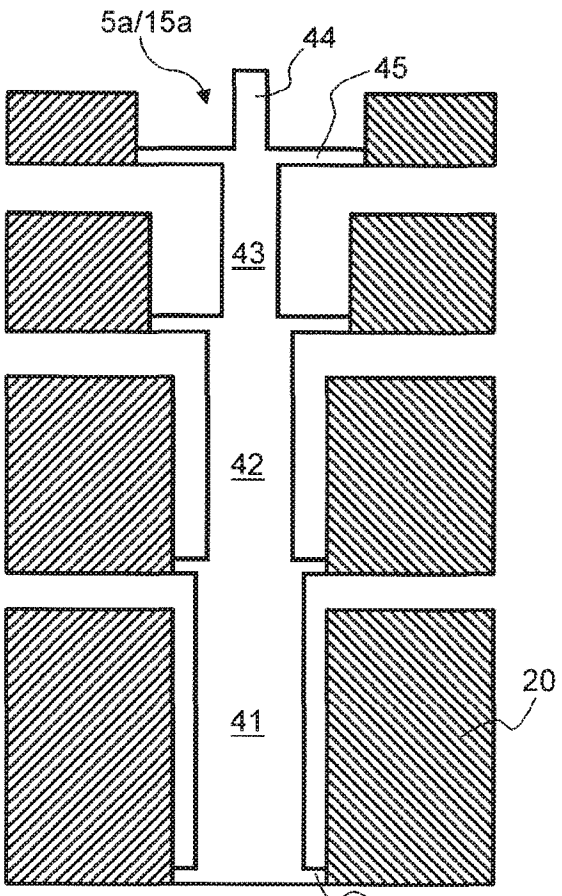
FIG. 4 shows a schematic illustration of a current lead in the normal-conducting region for the invention, with subsections of constant cross-sectional area, with cold reservoirs at the transition of subsections.

In FIG. 4, a further current lead 5*a* is shown in the normal-conducting region 15*a*, which substantially corresponds to the structural form of FIG. 3, and therefore only the essential differences will be explained.

The cold reservoirs 20 are each coupled on here at the transitions between the subsections 41-44 with short bridge elements 45, and in addition a pair of cold reservoirs 20 is coupled on at the lower, cold end 18*a* of the current lead 5*a* in the normal-conducting region 15*a* via bridge elements 45.

The current lead 5*a* is integrally manufactured here from a single part, for example, as a metal plate cut to size in the corresponding shape.

Figure 5:
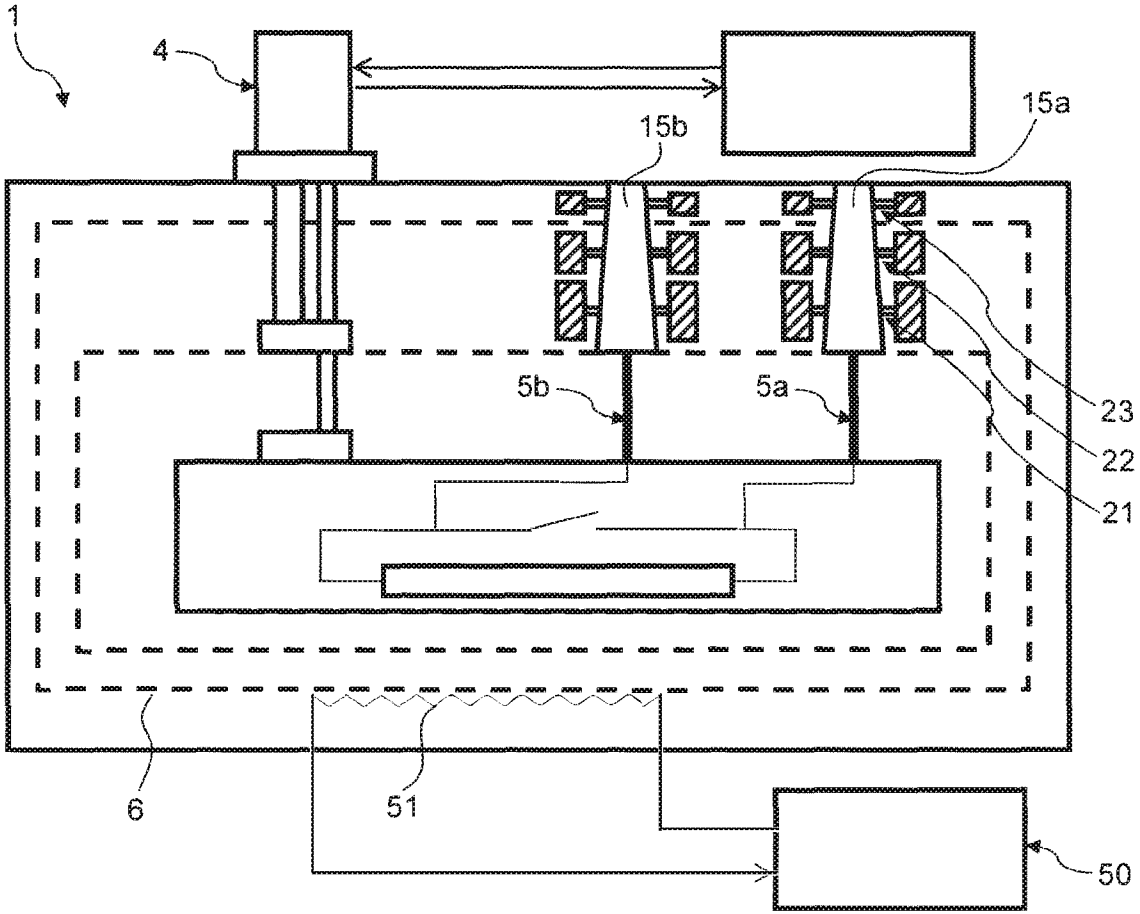
FIG. 5 shows a schematic illustration of a third embodiment of a magnet assembly according to the invention, with an auxiliary cooling device for cooling the outer radiation shield.

FIG. 5 shows a third embodiment of a magnet assembly 1 according to the invention, which substantially corresponds to the structural form of FIG. 1; only the essential differences will be explained hereafter.

In addition to the active cooling device 4, an active auxiliary cooling device 50 is also provided here, which is coupled via a heat exchanger 51 on the outer radiation shield 6. The outer radiation shield 6 in turn contacts a part (a piece) of the current leads 5*a*, 5*b* in the normal-conducting region 15*a*, 15*b*, here between the stages 22, 23 of the thermal coupling. The auxiliary cooling device 50 can reach a lowest working temperature $AT_{hilf}$ of approximately −60° C. here.

Via the auxiliary cooling device 50, a part of the thermal load arising during charging can be discharged from the current leads 5*a*, 5*b* in the normal-conducting region 15*a*, 15*b*, and therefore the active cooling device 4 is relieved. It is also possible to assist the cooling in normal operation with the auxiliary cooling device 50.

Figure 6:
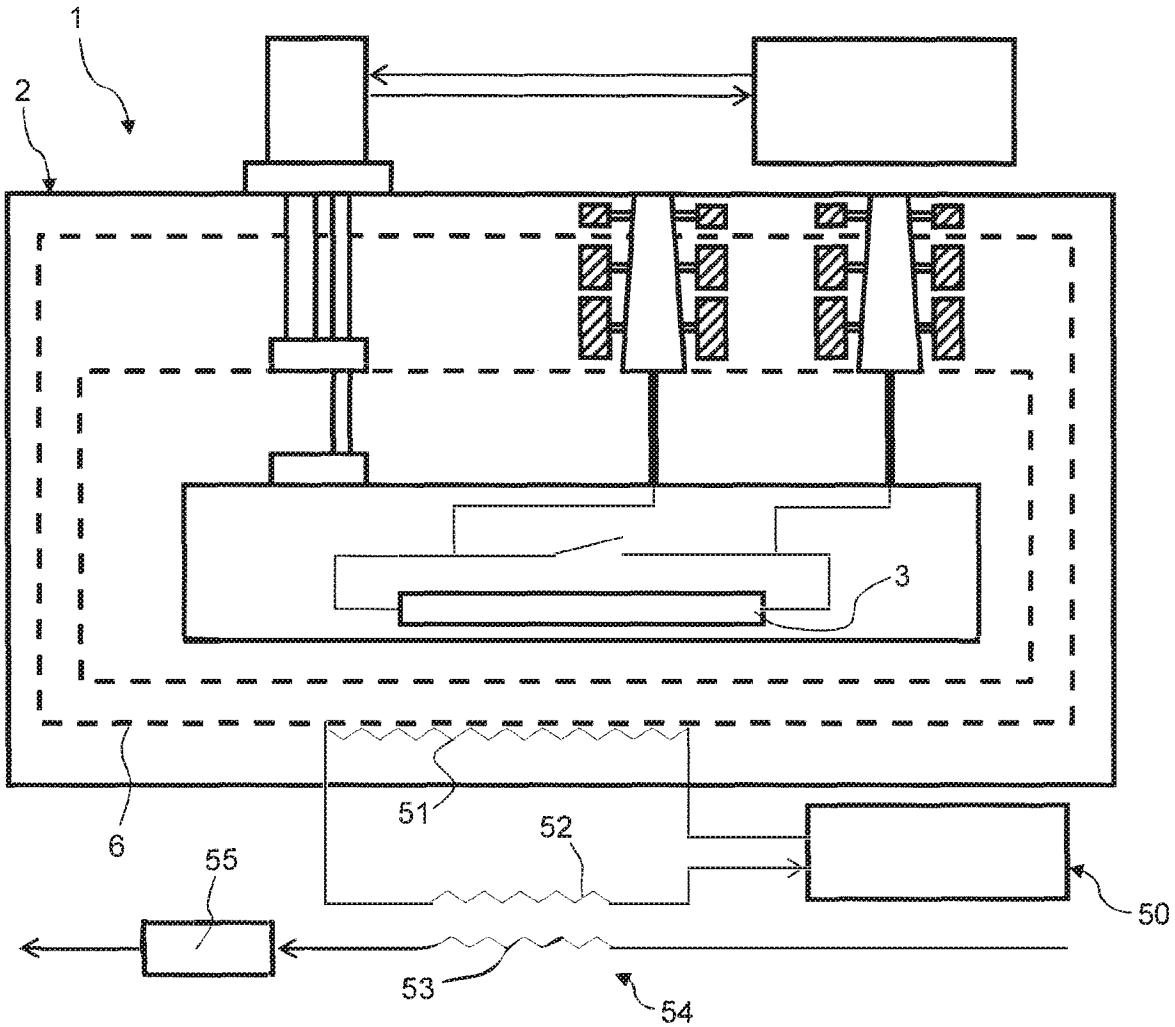
FIG. 6 shows a schematic illustration of a fourth embodiment of a magnet assembly according to the invention, with an auxiliary cooling device for cooling the outer radiation shield and a temperature control device of a sample to be studied.

FIG. 6 shows a fourth embodiment of a magnet assembly 1 according to the invention, which substantially corresponds to the structural form of FIG. 5, and therefore only the essential differences will be explained hereafter.

The active auxiliary cooling device 50 not only cools the heat exchanger 51 to the outer radiation shield 6 here, but rather also a heat exchanger 52, which in turn cools a heat exchanger 53 of a temperature control device 54 for a sample 55 to be studied. The sample 55 to be studied is kept at a constant temperature during its measurement by NMR spectroscopy in a room-temperature borehole (not shown in greater detail) of the cryostat 2 by the temperature control device 54, wherein the magnetic field generated in normal operation by the magnet coil system 3 of the magnet assembly 1 is used.

LIST OF REFERENCE SIGNS

1 magnet assembly
2 cryostat
3 superconducting magnet coil system
4 active cooling device
5*a*, 5*b* current leads
6 outer radiation shield
7 middle radiation shield
8 inner radiation shield
9 upper cooling stage (heat sink)
10 lower cooling stage (heat sink)
11 vacuum container
11*a* vacuum region
12 superconducting switch
12*a* superconducting charging and short-circuit electric circuit
13*a*, 13*b* connection (on the vacuum container)
14*a*, 14*b* connection (on the charging and short-circuit electric circuit)
15*a*, 15*b* normal-conducting region
16*a*, 16*b* HTS region
17*a*, 17*b* LT S region
18*a*, 18*b* cold end
19*a*, 19*b* warm end
20 cold reservoir
20*a* metallic body
21 coldest stage of the thermal coupling
22 middle stage of the thermal coupling
23 warmest stage of the thermal coupling
25, 26 subsection
27 container
28 evaporable substance
29 heat conduction element
30 container
41-44 subsection
45 bridge element
50 active auxiliary cooling device
51-53 heat exchanger
54 temperature control device
55 sample
B cross-sectional area
B1-B4 cross-sectional area (subsection)
H1-H4 length (subsection)
M1-M3 heavy masses

The invention claimed is:

1. A magnet assembly comprising:
a cryostat with a superconducting magnet coil system,
an active cooling device for the magnet coil system, and
current leads configured to charge the magnet coil system in the cryostat, wherein:
the current leads comprise at least one normal-conducting region,
multiple cold reservoirs are thermally coupled to the current leads along the normal-conducting region of the current leads, in order to absorb the heat arising in the normal-conducting region during the charging of the magnet coil system,
the current leads have a variable cross-sectional area B in the normal-conducting region along an extension direction of the current leads, and
at least over a predominant fraction of an overall length of the current leads in the normal-conducting region, the cross-sectional area B decreases from a cold end toward a warm end in the normal-conducting region.

2. The magnet assembly as claimed in claim 1, wherein the current leads in the normal-conducting region each have N successive subsections, with N≥2, and wherein the subsections each have a constant cross-sectional area Bi within a subsection, and the cross-sectional areas Bi decrease from the cold end toward the warm end.

3. The magnet assembly as claimed in claim 2, wherein different ones of the subsections are thermally coupled to different cold reservoirs.

4. The magnet assembly as claimed in claim 2, wherein pairs of the subsections comprise respective transitions and each transition of two subsections is thermally coupled to at least one respective cold reservoir.

5. The magnet assembly as claimed in claim 4, wherein the at least one cold reservoir is also thermally coupled onto the cold end of the current lead in the normal-conducting region.

6. The magnet assembly as claimed in claim 2, wherein 3≤N≤7.

7. The magnet assembly as claimed in claim 1, wherein K stages of the thermal coupling are configured along each of the current leads in the normal-conducting region, and wherein at least one cold reservoir is thermally coupled to the current leads at each stage, with $K \geq 2$.

8. The magnet assembly as claimed in claim 7, wherein a heavy mass Mi of cold-storing material in the at least one cold reservoir of a respective stage of the thermal coupling decreases over the stages from the cold end toward the warm end.

9. The magnet assembly as claimed in claim 7, wherein $3 \leq K \leq 7$.

10. The magnet assembly as claimed in claim 1, wherein the cryostat is configured as a cryogen-free cryostat.

11. The magnet assembly as claimed in claim 1, wherein at least some of the cold reservoirs are formed as gas-tight containers, and wherein a part of the volumes of the gas-tight containers are filled with an evaporable substance.

12. The magnet assembly as claimed in claim 11, wherein the current leads extend at least partially inside the containers in the normal-conducting region.

13. The magnet assembly as claimed in claim 8, wherein at least some of the containers are thermally coupled, respectively, with a lower end via a heat conduction element to a heat sink of the active cooling device, and the boiling point of the substance contained in the containers is greater than the temperature of the heat sink.

14. The magnet assembly as claimed in claim 1, wherein at least some of the cold reservoirs are formed as metallic bodies.

15. The magnet assembly as claimed in claim 14, wherein a plurality of the cold reservoirs formed as metallic bodies are arranged spaced apart from one another in a vacuum region of the cryostat.

16. The magnet assembly as claimed in claim 1, further comprising an active auxiliary cooling device, which is thermally coupled to respective sections of the current leads in the normal-conducting region.

17. The magnet assembly as claimed in claim 16, wherein the auxiliary cooling device is furthermore thermally coupled to a radiation shield of the cryostat and/or to a vacuum container of the cryostat and/or to a temperature control device for a sample under study.

18. The magnet assembly as claimed in claim 16, wherein a lowest working temperature $AT_{hilf}$ of the auxiliary cooling device is higher than a lowest working temperature $AT_{mss}$ of the active cooling device for the magnet coil system.

19. The magnet assembly as claimed in claim 1, wherein the cross-sectional area B changes from the cold end toward the warm end by at least a factor of 3.

20. A method for operating a magnet assembly as claimed in claim 1, comprising:

charging the magnet coil system via the current leads, selecting a charging current, and configuring the variable cross-sectional area B and/or the cold reservoirs such that: (i) for a thermal load $WL_{load}$, which acts maximally on a coldest stage of the current leads in the normal-conducting region during the charging, and (ii) for a thermal load $WL_{es}$ on the coldest stage in an equilibrium state with charged magnet coil system, the following applies:

$$WL_{load} \leq 5 * WL_{es}.$$

21. The magnet assembly as claimed in claim 20, wherein $WL_{load} \leq 2 * WL_{es}$.

22. The magnet assembly as claimed in claim 1, wherein the current leads further comprise a high-temperature superconductor (HTS) region.

* * * * *